US005441554A

United States Patent [19]

Romero et al.

[11] Patent Number: 5,441,554

[45] Date of Patent: Aug. 15, 1995

[54] ALLOY COATING FOR ALUMINUM BRONZE PARTS, SUCH AS MOLDS

[75] Inventors: Eduardo Romero, Coram; Richard J. DuMola, Centereach, both of N.Y.

[73] Assignee: Eutectic Corporation, Charlotte, N.C.

[21] Appl. No.: 116,003

[22] Filed: Sep. 2, 1993

[51] Int. Cl.[6] ..... B05D 1/08

[52] U.S. Cl. ..... 75/255; 420/486; 428/552

[58] Field of Search ..... 75/255; 420/441, 457, 420/458, 486, 490; 427/455, 419.1, 423; 428/546, 570, 621, 552

[56] References Cited

U.S. PATENT DOCUMENTS 4,039,318 8/1977 Patel ..... 75/225

4,196,237 4/1980 Patel et al. ..... 420/486

*Primary Examiner*—Scott Kastler

*Attorney, Agent, or Firm*—Hopgood, Calimafde, Kalil & Judlowe

[57] ABSTRACT

A blended flame spray powder composition is provided for use in producing a bonded wear resistant coating on an aluminum bronze substrate such as a glass mold part. The blended composition comprises a copper-base alloy mixed with a nickel-base alloy, the copper-base alloy powder comprising by weight about 5% to 15% aluminum, about 5% to 30% nickel, 0 to about 1% iron, about 0.1 to 1% silicon and the balance essentially copper. The nickel-base alloy powder comprises by weight 0 to about 0.5% carbon, 0 to about 1% manganese, 0 to about 21.5% chromium, 0 to about 7.5% iron, 0 to about 3.75% columbium, about 0.5% to 3% silicon, 0 to about 9% molybdenum, 0 to about 2% boron, 0 to about 2.5% phosphorus and the balance essentially nickel. The blending ratio of one powder to the other is such that a bonded coating produced therefrom on an aluminum bronze substrate, such as a glass mold part, contains at least about 9% copper and at least about 1.25% aluminum.

9 Claims, 1 Drawing Sheet

ALLOY COATING FOR ALUMINUM BRONZE PARTS, SUCH AS MOLDS

This invention relates to a powder blend comprising a mixture of a copper-base alloy and a nickel-base alloy for use in producing a bonded-nickel-base alloy coating on aluminum bronze parts, such as glass mold parts made of said bronze.

The invention also relates to a method for producing the coating and to a composite article of manufacture produced by the method.

STATE OF THE ART

It is known to form glass by shaping highly viscous molten glass in metal molds made usually of cast iron.

However, cast iron is subject to wear under high temperature molding conditions.

A method for preventing undue wear of cast iron glass molds is disclosed in U.S. Pat. No. 4,471,034, the disclosure of which is incorporated herein by reference. According to this patent, resistance to wear of cast iron glass molds is improved by coating the cast iron mold parts with a special nickel-base alloy containing by weight 0.5% to 5% titanium along with silicon and optionally some boron and manganese. The alloy coating is spray-deposited by means of a plasma transferred arc torch.

Reference is made to U.S. Pat. No. 4,943,698, which relates to hardfacing powders used in plasma transferred arc welding operations, such as in applying wear resistant coatings on metal substrates, for example, heads of engine valves. A problem in producing such coatings is the tendency towards weld porosity which is attributed to the liberation of oxygen and nitrogen from the hardfacing powder and base metal during the welding process. According to the patent, the tendency towards porosity is inhibited by adding a getter to the hardfacing powder prior to welding, the getter being selected from the group consisting of Al, Mn, Ti, Si, Zr, V, Li, Hf, Y, Na, Ca, rare earths, and master alloys thereof.

Nowhere in the patent is there any mention of providing the interior of glass molds with a hardfaced coating, particularly glass molds other than cast iron molds, such as molds made of an aluminum bronze alloy.

It would be desirable to provide glass mold parts made of material other than cast iron, a material having the desired heat of conductivity.

We have found that glass molds can be further improved by employing an aluminum bronze alloy as the glass mold part. An advantage of using aluminum bronze is its thermal conductivity which is important in molding glass in that the heat is withdrawn uniformly from the molten glass and thereby extend the life of the mold, provided the aluminum bronze mold has a protective metal coating produced from a special blended nickel-base alloy powder.

OBJECTS OF THE INVENTION

One object of the invention is to provide a method for producing a well-bonded nickel base alloy coating on glass mold parts made of an aluminum bronze.

Another object is to provide a blended flame spray powder comprising a mixture of a nickel-base and a copper-base alloy powder for use in coating aluminum bronze glass mold parts.

A still further object is to provide as an article of manufacture an aluminum bronze substrate coated with a nickel-base alloy using the plasma transferred arc technique.

These and other objects will more clearly appear when taken in conjunction with the following disclosure, the claims and the accompanying drawings.

As stated in U.S. Pat. No. 4,471,034, it is important that the plasma arc be controlled by maintaining a puddle of the deposited alloy between the plasma arc and the aluminum bronze substrate. This is particularly important with respect to the aluminum bronze substrate since it has a lower melting point than the cast iron substrate treated in U.S. Pat. No. 4,471,034.

Figure 1:
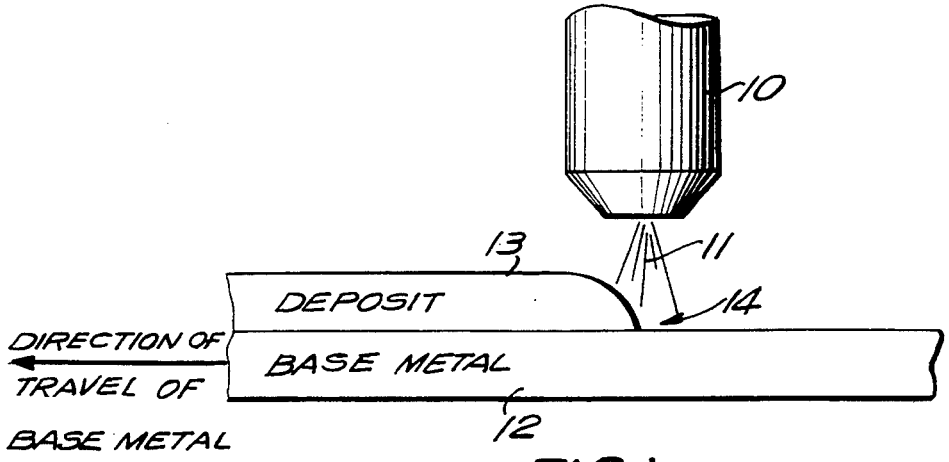
FIGS. 1 and 2 are schematic representations of plasma transferred arc welding outside and within the invention, respectively, as applied to an aluminum bronze substrate.
Figure 2:
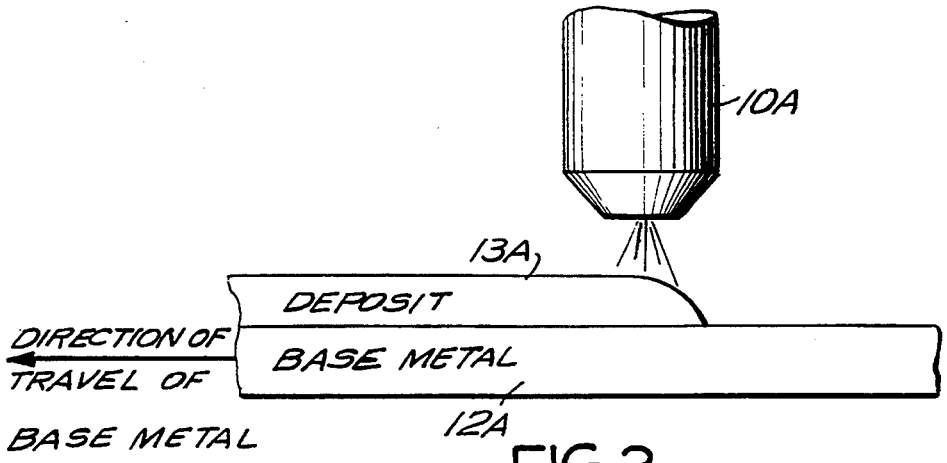
Figure 3:
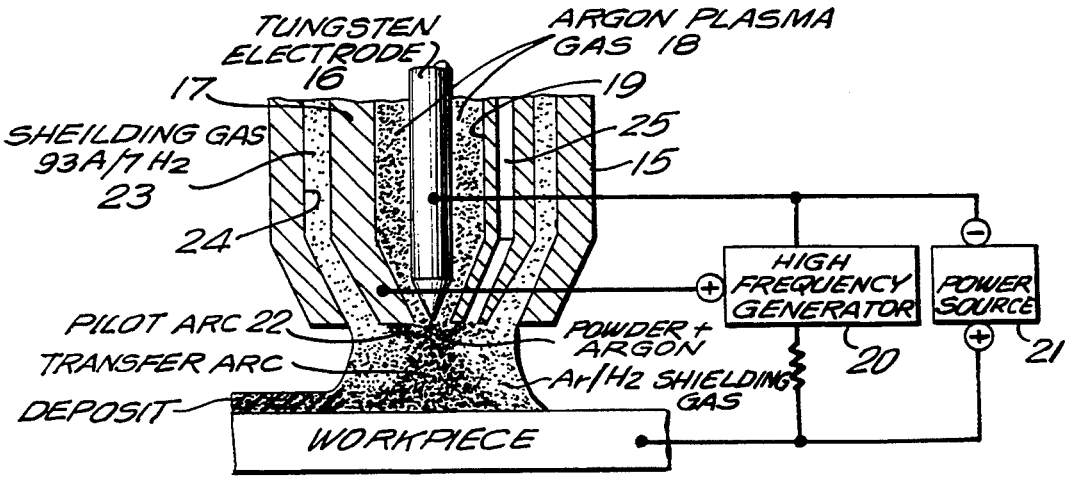
FIG. 3 depicts a cross section of a plasma transferred arc nozzle and a block diagram of an electrical circuit coupled to the nozzle and the metal substrate being coated using the plasma transferred arc technique.

Thus, referring to FIGS. 1 to 3, it will be noted that the method illustrated in FIG. 1 is undesirable as will be clearly apparent from the following description. The plasma nozzle 10 is shown depositing powder via plasma arc 11 onto base metal 12. A deposit 13 in the form of a puddle is formed with the plasma arc 11 leading the puddle to the extent that a good portion of the plasma arc strikes the metal substrate at 14, the substrate being a glass mold part.

On the other hand, FIG. 2 shows that by controlling the plasma arc and the relative rate of travel between the nozzle 10A and the workpiece, that is, by either moving the workpiece relative to the nozzle or by moving the nozzle relative to the workpiece, a puddle 13A of the coating alloy can be maintained and positioned relative to the nozzle such that it takes substantially the full brunt of the plasma arc and protects the metal substrate against direct contact with the arc.

The transfer arc relationship between the plasma torch and the workpiece or substrate is shown in the schematic and block diagram of FIG. 3 which depicts in cross section plasma torch 15 comprising a center tungsten electrode 16 surrounded by a water-cooled annular copper electrode 17. Argon plasma gas 18 is passed through the annular space 19 between the tungsten electrode 16 which is the cathode and the copper electrode 17 which is the anode. Referring to the block diagram to the right of the torch, the tungsten electrode 16 is shown coupled to the negative post of high frequency generator 20 which is connected in parallel with power source 21. Similarly, copper anode 17 is coupled to the positive post of the high frequency generator and the power source with the workpiece also coupled as the anode to assure the formation of the transfer arc.

A pilot arc 22 is formed at the end of the nozzle between the tungsten and copper electrodes which ionizes the argon gas 18 passing through the annular space around the tungsten electrode and initiates the transfer arc which is attracted to the workpiece, e.g. a glass mold part, by the higher potential of the workpiece which is the anode.

A shielding gas of either 93% argon plus 7% hydrogen 23 or argon is also provided flowing through the outer annular space 24. A separate supply of argon gas serves as the carrier and directs the powder through ports 25 into the plasma arc. The shielding gas aids in preventing oxidation of the deposit, which deposit just opposite the nozzle in turn protects the cast iron substrate from direct contact with the high temperature transfer arc. It should be added that the $Ar/H_2$ mixture is preferred as its use also improves the wettability of the molten alloy to the substrate. The details of the transfer arc system need not be further described. The system preferably employed is that referred to as the Eutronic Gap (tradename) process which utilizes the Eutronic Gap transferred arc torch sold by the Eutectic Corporation of Flushing, N.Y.

BACKGROUND OF THE INVENTION

Conventional technology for coating glass mold parts indicate that nickel-base alloys containing boron and silicon would be desirable as coating material since the presence of boron and silicon depresses the melting point,provides excellent wettability, exhibits good welding properties and good resistance to oxidation.

However, in using such nickel-base alloys, there was a tendency toward porosity throughout the coating.

When the Ni/B/Si alloys were applied to complex shapes varying in mass and size, the coating tended to crack at points of greatest stress as caused by differential expansion as would be expected on a bottle cavity mold.

In this connection, the following alloys were tested on aluminum bronze.

TABLE 1

| | % C | % Cr | % Fe | B | Si | Ni |
|---|---|---|---|---|---|---|
| Alloy 1 | 0.06 | — | 1.0 | 1.0 | 2.2 | Bal. |
| Alloy 2 | 0.06 | — | 1.0 | 1.9 | 2.75 | Bal. |
| Alloy 3 | 0.40 | 9.0 | 2.25 | 1.6 | 3.5 | Bal. |

All coatings showed porosity. Alloys 1 and 2 exhibited cracking.

A series of higher melting point nickel-base alloys were applied to aluminum bronze substrates as follows:

TABLE 2

| | % C | % Cr | % Fe | % Cb | % Si | % Mn | % Mo | Ni |
|---|---|---|---|---|---|---|---|---|
| Alloy 4 | 0.08 | 15.5 | 7.5 | 2.0 | 0.5 | 0.75 | — | Bal. |
| Alloy 5 | 0.10 | 21.5 | 3.75 | 3.65 | 0.5 | 0.50 | 9.0 | Bal. |

The coatings of Alloys 4 and 5 on aluminum bronze showed substantially less porosity than Alloys 1 to 3 but exhibited poor bonding.

TABLE 3

| | % Al | % Fe | % Si | % Ni | Cu |
|---|---|---|---|---|---|
| Alloy 6 | 9.0 | 1.0 | 0.3 | 5.0 | Bal. |
| Alloy 7 | 8.46 | 0.98 | 0.1 | 26.56 | Bal. |

Tests showed that Alloy 6 eliminated both porosity and cracking when blended with Alloys 3, 4 and 5. However, the machined coatings formed a blackish oxide layer upon heating to 1600° F. which was not acceptable for glass molds.

Blends of Alloy 4 and Alloy 7 produced coatings on the aluminum bronze substrate which were porosity free and crack free when the macrohardness of the coating was controlled to HRC 35 maximum. Increases in macrohardness due to melting and admixing of the alloy coating and the aluminum bronze substrate were controlled through normal surveillance of process parameters. Coatings were readily machinable and the desired macrohardness could be achieved by selecting the appropriate blend percentages and by controlling the weld current.

The tests indicated that the blending of selected nickel-base alloy powders with selected copper-base alloy powders produced acceptable coatings that were substantially free of porosity and cracks.

SUMMARY OF THE INVENTION

A method for producing a weld-bonded nickel-base alloy coating onto an aluminum bronze part is provided having minimum porosity at the weld interface and a hardness ranging from about HRC 20 to about 30 by using a plasma transferred arc process. The process is carried out by electrically coupling the base metal or substrate to the plasma-forming circuit, during which a flow of powdered metal is directed into the plasma arc to the surface of the bronze substrate.

The method further resides in controlling the nickel alloy deposit to maintain a molten puddle of the alloy between the transferred plasma arc and the bronze substrate similarly as disclosed in U.S. Pat. No. 4,471,034. Control of the weld puddle is important as it effects the degree of the melting of the base metal which tends to mix with the nickel alloy and thus create a new alloy having different properties.

The invention further relates to the design and manufacture of the nickel alloy powder which must compensate for the introduction of aluminum, zinc and copper from the aluminum bronze substrate and provide a composite coating alloy which is substantially free of defects such as cracks and porosity and which is well bonded to the bronze substrate. In addition, the coating should be machinable, have the desired macrohardness and the physical properties necessary to provide good wear performance at elevated glass molding temperatures.

DETAILS OF THE INVENTION

One embodiment of the invention resides in a blended flame spray powder composition for use in producing by the plasma transfer arc technique a strongly bonded nickel-base alloy coating on an aluminum bronze substrate, such as glass molds made of said aluminum bronze.

The blended composition comprises a copper-base alloy mixed with a nickel-base alloy.

The copper-base alloy comprises by weight about 5% to 15% aluminum, about 5% to 30% nickel, 0 to about 1% iron, about 0.1% to 1% silicon and the balance essentially copper.

The nickel-base alloy used in the blend contains by weight 0 to about 0.5% carbon, 0 to about 1% manganese, 0 to about 21.5% chromium, 0 to about 7.5% iron, 0 to about 3.75% columbium, about 0.5 to 3% silicon, 0 to about 9% molybdenum, 0 to about 2% boron, 0 to about 2.5% phosphorus, and the balance essentially nickel.

The blending ratio of the two powders is such that a bonded coating produced therefrom on an aluminum bronze substrate contains at least about 9% copper and at least about 1.25% aluminum.

The aluminum bronze substrate may comprise by weight about 8% to 10.5% aluminum, about 4% to 16% nickel, about 0.5% to 4.5% iron, 0 to about 10% zinc, 0 to about 0.3% manganese, less than about 0.1% tin and the balance essentially copper.

The blended composition may comprise about 15% to 40% by weight of the copper-base alloy and about 60% to 85% by weight of the nickel-base alloy.

A preferred blended composition is one containing by weight about 15% to 35% of the copper alloy and about 65% to 85% by weight of the nickel-base alloy.

As illustrative of the invention, the following examples are given.

EXAMPLE 1

A blend of 85% nickel-base alloy and 15% copper-base alloy by weight was produced from the following alloys.

| 85% Nickel-Base Alloy | 15% Copper-Base Alloy |
|---|---|
| 0.08% C | 8.46% Al |
| 15.5% Cr | 0.98% Fe |
| 7.5% Fe | 0.1% Si |
| 2.0% Cb | 26.56% Ni |
| 0.5% Si | Bal. Cu (63.91%) |
| 0.75% Mn | |
| Bal. Ni (75%) | |

The blended powders had a particle size range of −80+325 mesh (U.S. Standard).

The blended powders were applied to an aluminum bronze substrate using the plasma transferred arc process at a weld current of 80 amperes to produce a coating having a macrohardness of about HRC 20. The coating was substantially free of porosity and cracks.

The average composition by weight of the coating calculated approximately as follows: 0.07%C, 13.18% Cr., 6.52% Fe, 1.7% Cb, 0.44% Si, 0.64% Mn, 1.27% Al, 9.6% Cu and the balance nickel.

EXAMPLE 2

The following blended powders were applied to the aluminum bronze substrate via the plasma transferred arc process.

| 85% Nickel-Base Alloy | 15% Copper-Base Alloy |
|---|---|
| 0.1% C | 8.46% Al |
| 21.5% Cr | 0.98% Fe |
| 3.75% Fe | 0.10% Si |
| 3.65% Cb | 26.56% Ni |
| 0.50% Si | Bal. Cu (63.96%) |
| 0.50% Mn | |
| 9.0% Mo | |
| Bal. Ni (61.25%) | |

The blended powders were applied to the aluminum bronze substrate by means of the plasma transferred arc process resulting in a strongly bonded coating. The amount of current used during the process was 85 amperes. The macrohardness of the coating ranged from HRC 22 to 25.

EXAMPLE 3

| 85% Nickel-Base Alloy | 15% Copper-Base Alloy |
|---|---|
| 0.75% C | 8.46% Al |
| 2.60% Si | 0.98% Fe |
| 0.19% Fe | 0.10% Si |
| 2.06% P | 26.56% Ni |
| 0.18% Cr | Bal. Cu (64.21%) |

-continued

| 85% Nickel-Base Alloy | 15% Copper-Base Alloy |
|---|---|
| Bal. Ni (94.22%) | |

The coating of the foregoing blend was applied on the aluminum bronze substrate as in Examples 2 and 3, the weld current being 95 amperes. The hardness of the coating ranged from HRC 22 to 23.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. A blended flame spray powder composition for use in producing a bonded wear resistant coating on an aluminum bronze substrate, said blended composition consisting essentially of a copper-base alloy mixed with a nickel-base alloy, said copper-base alloy powder comprising by weight about 5% to 15% aluminum, about 5% to 30% nickel, 0 to about 1% iron, about 0.1 to 1% silicon and the balance essentially copper, said nickel-base alloy powder comprising by weight 0 to about 0.5% carbon, 0 to about 1% manganese, 0 to about 21.5% chromium, 0 to about 7.5% iron, 0 to about 3.75% columbium, about 0.5% to 3% silicon, 0 to about 9% molybdenum, 0 to about 2% boron, 0 to about 2.5% phosphorus and the balance essentially nickel, the blending ratio of one powder to the other being such that a bonded coating produced therefrom on an aluminum bronze substrate contains at least about 9% copper and at least about 1.25% aluminum.

2. The blended flame spray powder composition of claim 1, wherein the blended composition consists essentially of about 15% to 40% by weight of the copper-base alloy and the balance essentially about 60% to 85% by weight of said nickel-base alloy.

3. The blended flame spray composition of claim 2, wherein said composition consists essentially about 10% to 35% by weight of said copper-base alloy and about 65% to 85% by weight of said nickel-base alloy.

4. The blended flame spray composition of claims 1, 2 or 3, wherein the blended composition has an average particle size of less than about 80 mesh.

5. A flame spray method of producing a weld-bonded wear resistant coating on an aluminum bronze substrate by plasma transferred arc deposition, said aluminum bronze substrate comprising by weight about 8% to 10.5% aluminum, about 4% to 16% nickel, about 0.5% to 4.5% iron, 0 to about 10% zinc, 0 to about 0.3% manganese, less than about 0.1% tin and the balance essentially copper, said method comprising:

electrically coupling said aluminum bronze substrate to a plasma transferred arc torch having a nozzle through the end of which material to be sprayed is passed, activating said torch to produce a plasma flame at the end of said nozzle, passing a blended powder composition through said torch and said nozzle onto said aluminum bronze substrate, said blended composition consisting essentially by weight of a copper-base alloy powder mixed with a nickel-base alloy powder, said copper-alloy powder containing about 5% to 15% aluminum, about 5% to 30% nickel, 0 to about 1% iron, about 0.1% to 1% silicon and the balance essentially copper, said nickel-base alloy powder containing by weight about 0 to 0.5% carbon, 0 to about 21.5% chromium, 0 to about 7.5% iron, 0 to about 3.75% columbium, about 0.5% to 3% silicon, 0 to about 9% molybdenum, 0 to about 2% boron, 0 to about 2.5% phosphorus and the balance essentially nickel, the blending ratio of said copper-base alloy to said nickel-base alloy being such that a bonded coating produced therefrom on said substrate contains at least about 9% copper and at least about 1.25% aluminum, continuing said spraying to form a molten pool of said blended alloy composition on said substrate, and moving the torch or substrate relative to the other to complete the coating thereof while maintaining a pool of the molten alloy between the end of the nozzle and said substrate until the coating of the substrate is completed.

6. A composite article of manufacture comprising a substrate of an aluminum bronze alloy having a weld-bonded coating thereon comprising by weight 0 to about 0.45 carbon, at least about 1.25% aluminum, 0 to about 20% chromium, to about 7% iron, about 0.45 to about 2.7% silicon, 0 to about 2.5% phosphorus, 0 to about 8 molybdenum, 0 to about 3.5% columbium, 0 to 1.8% boron, at least about 9% copper and the balance essentially nickel, said weld-bonded coating having been produced by flame spraying onto said substrate a blended flame spray powder composition consisting essentially of a copper-base alloy mixed with a nickel-base alloy, said copper-base alloy powder comprising by weight about 5% to 15% aluminum, about 5% to 30% nickel, 0 to about 1% iron, about 0.1 to 1% silicon and the balance essentially copper, said nickel-base alloy powder comprising by weight 0 to about 0.5% carbon, 0 to about 1% manganese, 0 to about 21.5% chromium, 0 to about 7.5% iron, 0 to about 3.75% columbium, about 0.5% to 3% silicon, 0 to about 9% molybdenum, 0 to about 2% boron, 0 to about 2.5% phosphorus and the balance essentially nickel, the blending ratio of one powder to the other being such that the weld bonded coating produced therefrom on said aluminum bronze substrate contains said at least about 9% copper and said at least about 1.25% aluminum.

7. A glass mold part comprising an aluminum bronze substrate having a weld-bonded coating thereon comprising by weight 0 to about 0.45% carbon, at least about 1.25% aluminum, 0 to about 20% chromium, 0 to about 7% iron, 0.45 to about 2.7% silicon, 0 to about 2.5% phosphorus, 0 to about 8% molybdenum, 0 to about 3.55% columbium, 0 to 1.8% boron, at least about 9% copper and the balance essentially nickel, said weld-bonded coating having been produced by flame spraying onto said aluminum bronze substrate a blended flame spray powder composition comprising a copper-base alloy mixed with a nickel-base alloy said copper-base alloy powder comprising by weight about 5% to 15% aluminum, about 5% to 30% nickel, 0 to about 1% iron, about 0.1 to 1% silicon and the balance essentially copper, said nickel-base alloy powder comprising by weight 0 to about 0.5% carbon, 0 to about 1% manganese, 0 to about 21.5% chromium, 0 to about 7.5% iron, 0 to about 3.75% columbium, about 0.5% to 3% silicon, 0 to about 9% molybdenum, 0 to about 2% boron, 0 to about 2.5% phosphorus and the balance essentially nickel, the blending ratio of one powder to the other being such that a bonded coating produced therefrom on an aluminum bronze substrate contains at least about 9% copper and at least about 1.25% aluminum.

8. The composite article of manufacture as in claim 6, wherein the aluminum bronze substrate is comprised by weight of about 8% to 10.5% aluminum, about 4% to 16% nickel, about 0.5 to 4.5% iron, 0 to about 10% zinc, 0 to about 0.3% manganese, less than about 0.1% tin and the balance essentially copper.

9. The glass mold part as in claim 7, wherein the aluminum bronze substrate is comprised by weight of about 8% to 10.5% aluminum, about 4% to 16% nickel, about 0.5 to 4.5% iron, 0 to about 10% zinc, 0 to about 0.3% manganese, less than about 0.1% tin and the balance essentially copper.

* * * * *